US005289352A

United States Patent [19]

Remus et al.

[11] Patent Number: 5,289,352

[45] Date of Patent: Feb. 22, 1994

[54] HEADLAMP FOR MOTOR VEHICLES

[75] Inventors: Bodo Remus, Reutlingen/Altenburg; Dieter Sieber, Mössingen; Jürgen Stein, Stuttgart; Günter Hege, Gomaringen; Tilman Spingler, Kohlberg; Friedrich Schmied, Pfullingen; Peter Kusserow, Sonnenbühl; Hans-Jürgen Schneider, Tübingen; Christian Jäger; Bernhard Wörner, both of Stuttgart; Fred Delb, Bühl-Oberweier; Thomas Weigold, Baden-Baden; Kay Kolberg, Ottersweier; Karl-Heinrich Preis, Bühlertal, all of Fed. Rep. of Germany

[73] Assignee: Robert Bosch GmbH, Stuttgart, Fed. Rep. of Germany

[21] Appl. No.: 834,275

[22] PCT Filed: Jun. 12, 1991

[86] PCT No.: PCT/DE91/00493

§ 371 Date: Feb. 12, 1992

§ 102(e) Date: Feb. 12, 1992

[87] PCT Pub. No.: WO91/19938

PCT Pub. Date: Dec. 26, 1991

[30] Foreign Application Priority Data

Jun. 24, 1990 [DE] Fed. Rep. of Germany ..... 4019641
Mar. 23, 1991 [DE] Fed. Rep. of Germany ..... 4109657

[51] Int. Cl.[5] ..... F21M 3/14

[52] U.S. Cl. ..... 362/61; 362/21; 362/293; 362/351

[58] Field of Search ..... 362/61, 21, 80, 293, 362/351

[56] References Cited

U.S. PATENT DOCUMENTS

| | | | |
|---|---|---|---|
| 3,767,288 | 10/1973 | Gross | 362/80 |
| 4,862,328 | 8/1989 | Nino | 362/351 |
| 4,868,726 | 9/1989 | Segoshi | 362/351 |
| 4,951,178 | 8/1990 | Shirai et al. | 352/61 |
| 4,985,816 | 1/1991 | Seko | 362/293 |

FOREIGN PATENT DOCUMENTS

| | | |
|---|---|---|
| 0043114 | 1/1982 | European Pat. Off. . |
| 0358417 | 3/1990 | European Pat. Off. . |
| 2155378 | 6/1972 | Fed. Rep. of Germany . |
| 3936374 | 5/1991 | Fed. Rep. of Germany . |
| 8903778 | 5/1989 | PCT Int'l Appl. . |
| 1364927 | 8/1974 | United Kingdom . |

*Primary Examiner*—Richard R. Cole
*Attorney, Agent, or Firm*—Michael J. Striker

[57] ABSTRACT

A headlamp for motor vehicles has a reflector, a gas discharge lamp, a front plate covering a light exit opening of the headlamp, and a filter arranged in a beam path of light beams reflected by the reflector and light beams transmitted directly to the front plate and at least partially absorbing light in a UV wavelength region.

33 Claims, 3 Drawing Sheets

HEADLAMP FOR MOTOR VEHICLES

BACKGROUND OF THE INVENTION

The present invention relates to a headlamp for motor vehicles.

More particularly, it relates to a headlamp which has a gas discharge lamp and a front plate which covers the light exit opening of the headlamp.

Such a headlamp is disclosed in the German Offenlegungsschrift 35 19 611. This headlamp has a reflector into which a gas discharge lamp is inserted as a light source. The light exit opening of the headlamp is covered with a front plate. Apart from visible light, the gas discharge lamp also transmits light in the UV wavelength region of high intensity. This UV light is, on the one hand, noxious and, on the other hand, can destroy plastics and glass. The heat radiation of the gas discharge lamp is substantially smaller in comparison with an incandescent lamp so that moisture which has penetrated the headlamp or has been precipitated on the front plate does not dry and moisture which has frozen onto the front plate does not thaw. In addition, under certain circumstances the light transmitted by the gas discharge lamp has an excessively high blue fraction.

SUMMARY OF THE INVENTION

Accordingly, it is an object of the present invention to provide a headlamp for motor vehicles which avoids the disadvantages of the prior art.

In keeping with these objects and with others which will become apparent hereinafter, one feature of the present invention resides, briefly stated, in a headlamp in which the beam path of the light beams reflected by the reflector and the light beams transmitted directly to the front plate from the gas discharge lamp contains a disc-shaped filter which is arranged so as to at least partially absorb light in the UV region.

When the headlamp is designed in accordance with the present invention, it has, in contrast with the above, the advantage that the light transmitted by the gas discharge lamp in the UV wavelength region is absorbed by the filter and thus no UV radiation at a harmful intensity can emerge from the headlamp.

In accordance with another advantageous feature of the present invention, the front plate is provided with a coating which absorbs light in the UV wavelength region or consists of a UV light absorbing material and serves as the filter. With such a design of the front plate as a UV filter, a selective heating of the same is achieved so that during the operation of the gas discharge lamp moisture which has been precipitated on the front plate is dried and moisture which has frozen onto it thaws.

In accordance with another feature of the present invention, the lens is arranged in a holder, and the holder has a component with an electrical line, and the electrical line is interrupted when the lens impacts against the component with a specific force, and operation of the gas discharge lamp is prevented when the line is interrupted. When the headlamp is designed in accordance with these features it is ensured that even with a damaged UV filter no UV radiation emerges from the headlamp.

It is possible, in accordance with a further development, that the line is realized as a conductor track mounted on the component, and the component is broken in such a way by the lens when it impacts against the component that the conductor track is interrupted. In this construction the line is interrupted in the case of a lens which is moved out of the holder for example as a result of an impact and thus in a simple manner the failure of the lens is indicated.

Finally, a voltage divider circuit can be provided in the line, and the control device can have an evaluation circuit by means of which the operation of the gas discharge lamp is prevented in the event of a voltage drop in the line deviating from a voltage drop predetermined by the voltage divider circuit. In this case, it is ensured that the gas discharge lamp cannot be operated even with a damaged UV filter due to short circuiting of the signalling lines.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
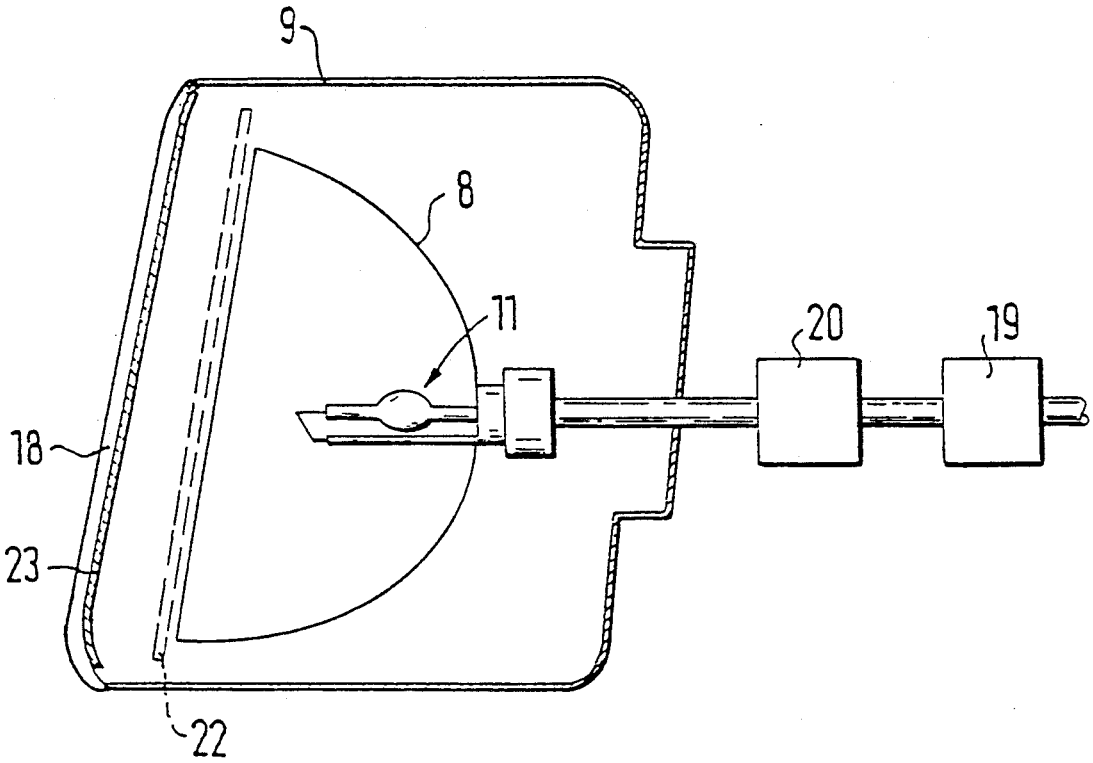
FIG. 1 shows a first exemplary embodiment of a headlamp in longitudinal section in a greatly simplified view.

In a first exemplary embodiment illustrated in FIG. 1 of a dipped light headlamp for motor vehicles, the headlamp has a reflector 8 and a gas discharge lamp 11 inserted from its rear. The reflector 8 can be in the shape for example of a rotational paraboloid but also divided up into a plurality of different segments and is arranged in a housing 9 made of plastic. The light exit opening of the headlamp is closed off with a front plate 18 which is constructed as a lens plate. The gas discharge lamp 11 is supplied with the high voltage required for its operation by means of an ignition device 20 which is supplied from the electrical system of the motor vehicle and actuated by a control device 19. Apart from visible light, the gas discharge lamp 11 also transmits light in the UV wavelength region at a high intensity during its operation. The front plate 18 is provided on its inside pointing towards the reflector with a coating 23 which at least partially absorbs light in the UV wavelength region. The coating 23 can be formed by means of a thin metal layer for example of gold or chromium. However, the coating 23 can also be formed by a fluoride layer. The coating 23 can, for example, be evaporated or sprayed onto the front plate 18. In addition, by means of the coating 23 not only is a shielding against UV radiation provided, but it also increases the quality of the glass optics constituted in the front plate 18 so that an undesired scattering of the light beams passing through is reduced.

The coating 23 heats up due to the absorbed UV radiation, which leads to a heating up of the front plate 18. Thus, a heating up of the front plate 18 to accelerate the drying and deicing of the front plate is achieved without the use of extraneous energy. In place of the coating 23, the front plate 18 itself can also have the property of absorbing UV light by appropriate selection of the glass material or by means of appropriate additives to the glass material. By means of a brownish colouring of the coating 23 or of the front plate 18 the light emerging from the headlamp can be given a colouring so that it has a "warmer" effect. In addition, the coating 23 or the front plate 18 can be constructed in such a way that blue light is partially absorbed so that the light emerging from the headlamp appears less blue.

By means of the colouring of the coating 23 or of the front plate 18 heating up of the front plate 18 during operation of the gas discharge lamp 11 is also achieved.

In a variant of the headlamp, instead of constructing the front plate as a UV filter, a disc-shaped filter 22, indicated in FIG. 1 by dashed lines, is arranged between the gas discharge lamp 11 and the front plate 18. The filter 22 is provided with a UV light-absorbing coating 23 as described for the front plate above or has the property of absorbing UV light by means of corresponding selection of material or by means of additives to a glass material.

Figure 2:
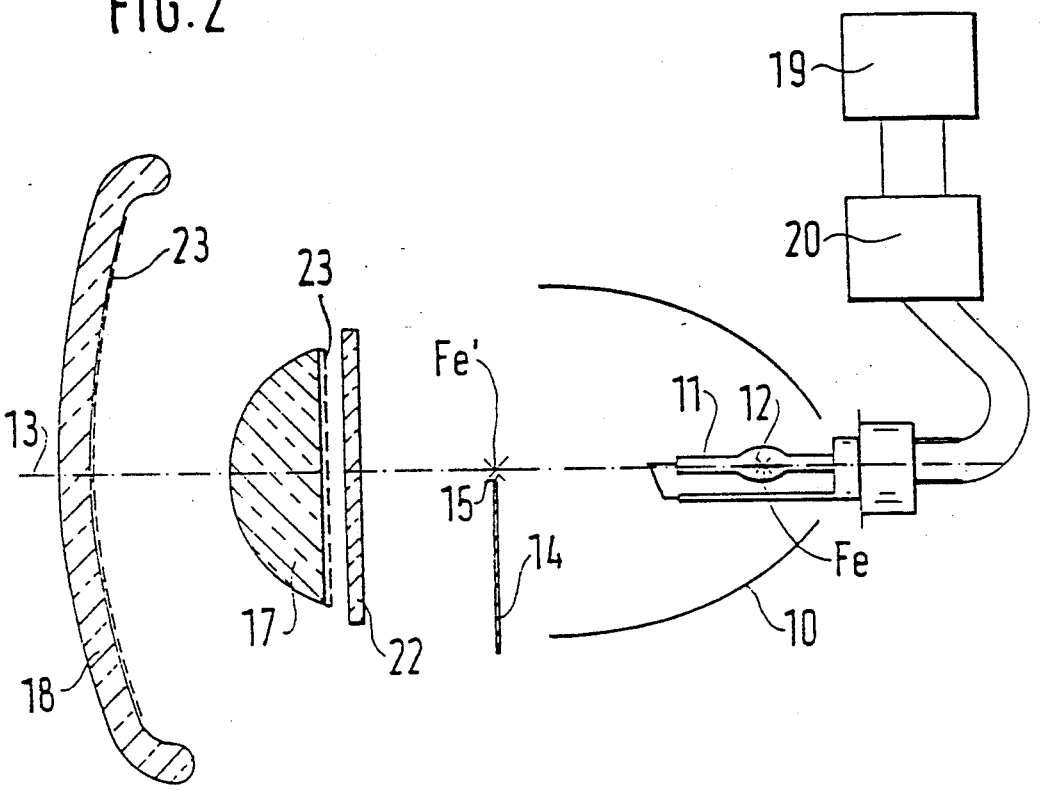
FIG. 2 shows second exemplary embodiment of a headlamp in longitudinal section.

In a second exemplary embodiment illustrated in FIG. 2 of a dipped light headlamp for motor vehicles, the lamp has a reflector 10 into which a gas discharge lamp 11 is inserted from its rear. In the vertical and horizontal meridian section of the reflector 10 ellipses are produced, and the axial light arc 12 of the gas discharge lamp 11 is being arranged in the region of the inner focal point Fe of the ellipses on the optical axis 13 of the reflector. In the direction of the light beams reflected by the reflector 10, a shade 14 with an optically active upper edge 15 is arranged below the optical axis 13 in the region of the outer focal point Fe' of the ellipses. Furthermore, a lens 17 and a front plate 18 which covers the light exit opening of the headlamp and can be constructed as a lens plate are arranged in the light exit direction. During the operation of the gas discharge lamp 11 the light beams form an image of the upper edge 15 of the shade 14 via the lens 17 as a light/dark border of the light distribution of the headlamp.

The lens 17 serves as a UV filter for shielding the UV light of the gas discharge lamp 11 and is provided with a coating 23 which absorbs UV light. The coating 23 can be realised as described in the first exemplary embodiment. In addition, the lens 17 can also be given UV light-absorbing properties by means of a suitable glass material or by additives to the glass material. Alternatively, a disc-shaped UV filter 22 can be arranged in the headlamp of the second exemplary embodiment between the gas discharge lamp 11 and the front plate 18 or the front plate 18 can serve as a UV filter by means of a coating 23 or a suitable glass material.

Figure 4:
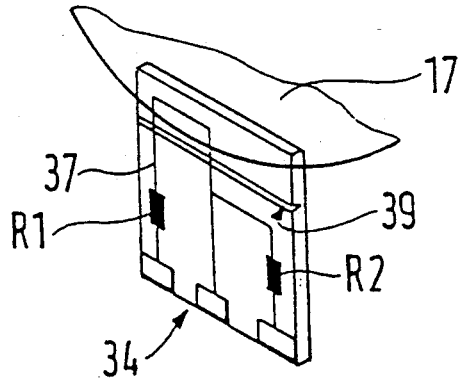
FIG. 3 shows a third exemplary embodiment of a headlamp in longitudinal section and FIG. 4 shows a portion, designated in FIG. 3 by IV, in a perspective view.
Figure 3:
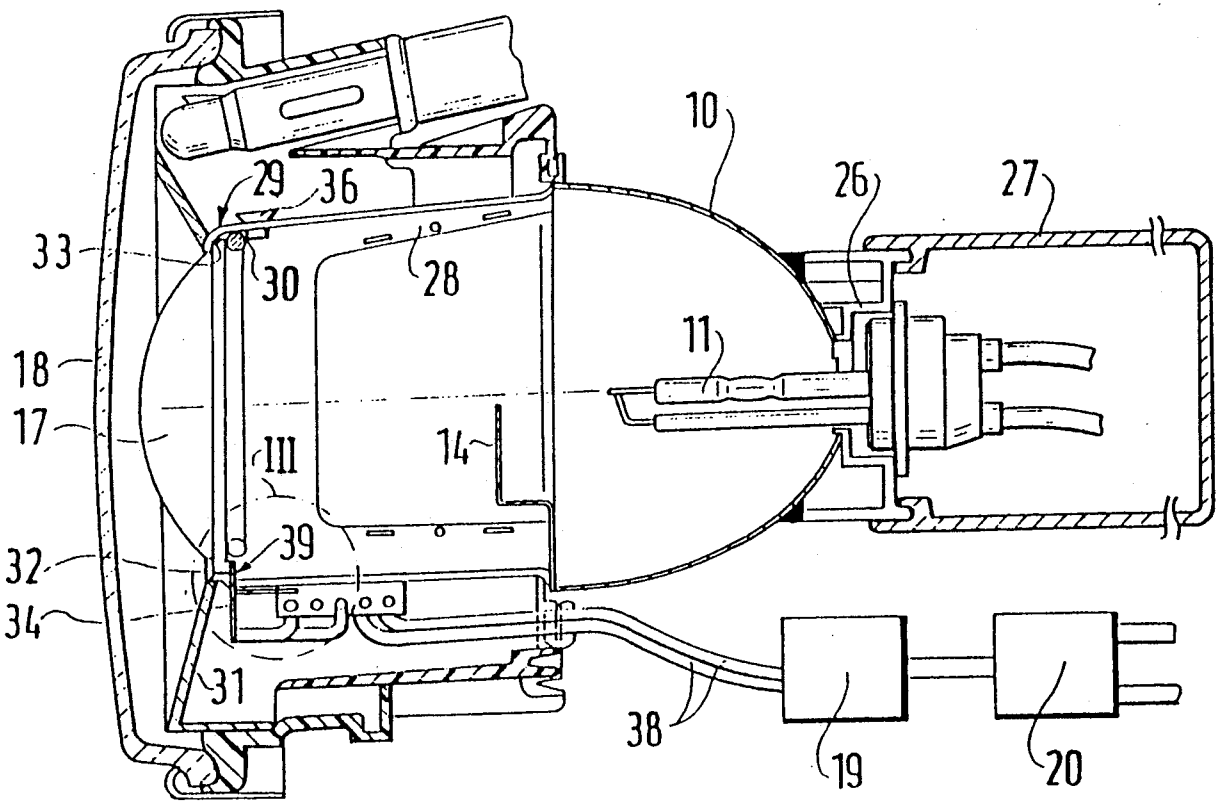

In FIGS. 3 and 4 a third exemplary embodiment of the headlamp is illustrated in which, as in the second exemplary embodiment, the lens 17 serves as a UV filter and by means of a coating or a suitable glass material or additives to the glass material has the property of absorbing UV light. The gas discharge lamp 11 is inserted by means of a lamp carrier 26 into the reflector 10 and covered at its rear with a cap 27.

A carrier 28 which extends in the light exit direction and has on its end pointing away from the reflector 10 a holder 29 for receiving the lens 17 is connected to the front edge of the reflector 10. The carrier 28 is realised as a hollow cylinder which is closed at its circumference and consists of sheet metal. The reflector 10 forms with the carrier 28 and the lens 17 a tight bond so that UV radiation cannot emerge through these parts or between them. A frame 31 which has an opening 32 the same size as the lens 17 for the passage of light is arranged towards the lens plate 18. The lens 17 can be inserted into the carrier 28 from its end pointing towards the reflector 10 and comes to rest in the light exit direction against an edge 33 of the carrier 28 forming a part of the holder 29 and pointing radially inwards, and against which it is held by means of a resilient ring 30. The resilient ring 30 is open in its lower region. A stop 36, which is a rivet here, is arranged on the carrier 28 on one side, here at the top, between which stop and the edge 33 the edge of the lens 17 and the resilient ring 30 come to rest in the mounted state of the lens. Preferably diametrically opposite, a ceramic plate 34 can be attached to the carrier 28 and projects radially inwards through the open region of the resilient ring 30 when the lens 17 is mounted and engages over the edge of the lens 17 towards the side of the reflector 10. In this arrangement, the ceramic plate 34 could also serve for fixing the position of the lens 17 at this point if the resilient ring 30 is dispensed with.

An electrical conductor track 37 is evaporated onto the ceramic plate 34 and connected via signalling lines 38 to the electrical control device 19 which actuates the ignition device 20. The ceramic plate 34 has a predetermined break point determined by a notch 39, the conductor track 37 extending beyond the notch 39 on the ceramic plate 34. The notch 39 is arranged in such a way that when a force of a specific magnitude acts on the lens 17 in the direction of the reflector 10 the ceramic plate 34 is broken by the lens 17 which moves out of the holder 29 in its lower region as a result of the corresponding holder 36, as a result of which the conductor track 37 is interrupted. If the resilient ring 50 serves for fixing the lens 17, the ceramic plate 34 can be arranged at a small distance from the lens so that during operation it is not subjected to any vibratory loads from the lens which could lead to an undesired break. By means of a safety circuit of the control device 19, an interruption of the conductor track 37 is detected and the operation of the gas discharge lamp 11 prevented. Thus, it is ensured that in the event for example of a lens 17 which is damaged as a result of an accident no UV radiation emerges from the headlamp and no parts at a high voltage can be touched. However, if only the front plate 18 is destroyed and the lens 17 is still in its holder 29, the headlamp can continue to operate since the bond between the reflector, carrier and lens parts is still intact and no harmful UV radiation can emerge. The carrier 28 and the ceramic plate 34 and their electrical connections are covered by the frame 31.

As a further safety measure, a voltage divider circuit which has two resistors R1 and R2 at which a defined voltage drop occurs can be mounted on the ceramic plate 34. By means of the predetermined break, one of the lines of the voltage divider is interrupted so that the voltage drop changes substantially in relation to the other branch of the voltage divider circuit and thus the fault is indicated. If a voltage drop which deviates from the predetermined voltage drop occurs, this is detected by the safety circuit of the control device 19 and the operation of the gas discharge lamp 11 is prevented. Thus it is prevented that, for example due to short circuiting of the signalling lines 38, the gas discharge lamp 11 can be operated even when the lens 17 is damaged.

It will be understood that each of the elements described above, or two or more together, may also find a useful application in other types of constructions differing from the types described above.

While the invention has been illustrated and described as embodied in a headlamp for motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlamp for motor vehicles, comprising a reflector; a gas discharge lamp; a front plate covering a light exit opening of the headlamp; a filter arranged in a beam path of light beams reflected by said reflector and light beams transmitted directly to said front plate and at least partially absorbing light in a UV wavelength region; a shade arranged in the beam path of the light beam reflected by said reflector; a lens arranged in the beam path of the beams influenced by the shade and forming an image of an edge of said shade as the light-/dark border of a light distribution, said lens being formed as a filter; and a holder which holds said lens and has a component with an electrical line such that said electrical line is interrupted when said lens impacts against said component with a specific force, and operation of said gas discharge lamp is prevented when said electrical line is interrupted.

2. A headlamp as defined in claim 1, wherein said filter is formed as a disc-shaped filter.

3. A headlamp as defined in claim 1, wherein said filter is formed as a disc and arranged between said gas discharge lamp and said front plate.

4. A headlamp as defined in claim 3, wherein said disc is coated with a UV light-absorbing coating.

5. A headlamp as defined in claim 3, wherein said disc is composed of a UV light absorbing material.

6. A headlamp as defined in claim 1, wherein said front plate forms said filter.

7. A headlamp as defined in claim 6, wherein said front plate is provided with a coating which absorbs light in the UV wavelength region.

8. A headlamp as defined in claim 6, wherein said front plate is composed of a UV light-absorbing material.

9. A headlamp as defined in claim 1, wherein said lens is provided with a coating which absorbs in the UV wavelength region.

10. A headlamp as defined in claim 1, wherein said lens is composed of a UV light-absorbing material.

11. A headlamp as defined in claim 1, wherein said filter is provided with a metal coating composed of a material selected from the group consisting of gold and chromium.

12. A headlamp as defined in claim 1, wherein said filter is provided in said fluoride coating.

13. A headlamp as defined in claim 1, wherein said filter has a brownish coloring.

14. A headlamp as defined in claim 1, wherein said filter absorbs light in a blue wavelength region.

15. A headlamp as defined in claim 1, wherein said electrical line is formed as a conductor track mounted on said component, and the component is broken in such a way by said lens when it impacts against said component that said conductor track is interrupted.

16. A headlamp as defined in claim 1, wherein said component is composed of ceramic and provided with a predetermined break point.

17. A headlamp as defined in claim 1, and further comprising an electrical control device having a safety circuit and signalling lines which connect said line to said electrical control device, so that prevention of the operation of the gas discharge lamp is performed by means of said safety circuit of said electrical control device when at least one of said line and said signalling line is interrupted.

18. A headlamp as defined in claim 17, and further comprising a voltage divider circuit located in said electrical line, said electrical control device having an evaluation circuit which prevents the operation of the gas discharge lamp in the event of a voltage drop in said electrical line deviating from a voltage drop predetermined by said voltage divider circuit.

19. A headlamp as defined in claim 18, wherein said voltage divider circuit is arranged on said component.

20. A headlamp as defined in claim 1, wherein said filter is provided with a fluoride coating.

21. A headlamp for motor vehicles, comprising a reflector; a gas discharge lamp; a front plate covering a light exit opening of the headlamp; a filter arranged in a beam path of light beams reflected by said reflector and light beams transmitted directly to said front plate and at least partially absorbing light in a UV wavelength region; a shade arranged in the beam path of the light beam reflected by said reflector; a lens arranged in the beam path of the beams influenced by the shade and forming an image of an edge of said shade as the light-/dark border of a light beam reflected by said reflector; a lens arranged in the beam path of the beams influenced by the shade and forming an image of an edge of said shade as the light/dark border of a light distribution, said lens being formed as a filter; a carrier which is connected with said reflector and formed as a hollow cylinder closed at its circumference, said lens being arranged in said carrier, said carrier having a radially inwardly pointing edge; and a radially elastically resilient ring, said lens being held resting against aid radially inwardly pointing edge of said carrier by means of said radially elastically resilient ring which is inserted in said carrier.

22. A headlamp as defined in claim 21, wherein said filter is formed as a disc-shaped filter.

23. A headlamp as defined in claim 21, wherein said filter is formed as a disc and arranged between said gas discharge lamp and said front plate.

24. A headlamp as defined in claim 23, wherein said disc is coated with a UV light-absorbing coating.

25. A headlamp as defined in claim 23, wherein said disc is composed of a UV light absorbing material.

26. A headlamp as defined in claim 21, wherein said front plate forms said filter.

27. A headlamp as defined in claim 26, wherein said front plate is provided with a coating which absorbs light in the UV wavelength region.

28. A headlamp as defined in claim 26, wherein said front plate is composed of a UV light-absorbing material.

29. A headlamp as defined in claim 21, wherein said lens is provided with a coating which absorbs in the UV wavelength region.

30. A headlamp as defined in claim 21, wherein said lens is composed of UV light-absorbing material.

31. A headlamp as defined in claim 21, wherein said filter is provided with a metal coating compound of a material selected from the group consisting of gold and chromium.

32. A headlamp as defined in claim 21, wherein said filter has a brownish coloring.

33. A headlamp as defined in claim 21, wherein said filter absorbs light in a blue wavelength region.

* * * * *